US008967404B2

(12) United States Patent
Sagawa et al.

(10) Patent No.: US 8,967,404 B2
(45) Date of Patent: Mar. 3, 2015

(54) DEVICE FOR COUPLING HIGH-SPEED RAILROAD CARS AND METHOD FOR REMOVING DEVICE

(75) Inventors: Kazuhiko Sagawa, Osaka (JP); Yoshinori Ishihara, Osaka (JP); Teruhiko Yahaba, Tokyo (JP); Kazuyoshi Kitaya, Hyogo (JP); Kazuki Fujii, Hyogo (JP)

(73) Assignees: Nippon Steel & Sumitomo Metal Corporation, Tokyo (JP); East Japan Railway Company, Tokyo (JP); Kawasaki Jukogyo Kabushiki Kaisha, Hyogo (JP)

( * ) Notice: Subject to any disclaimer, the term of this patent is extended or adjusted under 35 U.S.C. 154(b) by 58 days.

(21) Appl. No.: 13/825,153

(22) PCT Filed: Sep. 22, 2011

(86) PCT No.: PCT/JP2011/071633

§ 371 (c)(1), (2), (4) Date: Jun. 10, 2013

(87) PCT Pub. No.: WO2012/039459

PCT Pub. Date: Mar. 29, 2012

(65) Prior Publication Data

US 2014/0144863 A1 May 29, 2014

(30) Foreign Application Priority Data

Sep. 24, 2010 (JP) ..... 2010-213867

(51) Int. Cl.

| | |
|---|---|
| ***B61G 9/00*** | (2006.01) |
| ***B61G 1/00*** | (2006.01) |
| ***B61G 7/10*** | (2006.01) |

(Continued)

(52) U.S. Cl.

CPC .. *B61G 1/00* (2013.01); *B61G 7/10* (2013.01); *B61G 11/08* (2013.01); *B61G 11/00* (2013.01)

USPC ..... 213/7; 213/62 A; 213/62 R

(58) Field of Classification Search

USPC ..... 213/7–14, 62 A

See application file for complete search history.

(56) References Cited

U.S. PATENT DOCUMENTS

| | | | | | |
|---|---|---|---|---|---|
| 2,990,962 | A | * | 7/1961 | Nystrom | 213/62 A |
| 2,990,963 | A | * | 7/1961 | Kulieke | 213/62 A |
| 3,220,562 | A | * | 11/1965 | Baker | 213/62 R |

(Continued)

FOREIGN PATENT DOCUMENTS

| | | |
|---|---|---|
| JP | 44-16967 | 7/1969 |
| JP | 2002-234438 | 8/2002 |
| JP | 2005-219685 | 8/2005 |

*Primary Examiner* — Jason C Smith

(74) *Attorney, Agent, or Firm* — Clark & Brody

(57) ABSTRACT

A device for coupling tilting railroad cars onto a high-speed railroad train comprises a coupler and a shock absorber held in a shock absorber frame, each joined by a coupling pin via a coupling joint. The frame includes a front inner surface with a front end wall opening and a cylindrical surface extending to a semi-circular concave inner surface. The joint includes a rounded convex surface engaged with a semi-circular concave surface, a circumferential surface of a short cylinder receiving the rear portion of the coupler, and an insertion hole which is provided in a direction perpendicular to the axis of the short cylinder. The frame has a removal hole and an air removal pin of the coupling pin facing each other at a position to rotate at a predetermined angle in a circumferential direction in the assembled state, and at a position coaxial with the coupling pin in the assembled state.

6 Claims, 4 Drawing Sheets

(51) Int. Cl.
*B61G 11/08* (2006.01)
*B61G 11/00* (2006.01)

(56) References Cited

U.S. PATENT DOCUMENTS 4,230,228 A * 10/1980 Kaim ..... 213/62 A
4,428,489 A * 1/1984 Hanula ..... 213/62 A
5,507,400 A * 4/1996 Long et al. ..... 213/75 R
5,967,349 A * 10/1999 Engelbrecht ..... 213/74
6,234,702 B1 * 5/2001 Jeunehomme et al. ..... 403/78
6,568,649 B1 * 5/2003 Schmitt ..... 248/551
6,796,448 B1 * 9/2004 Wilt et al. ..... 213/40 R
8,051,995 B2 * 11/2011 Kontetzki et al. ..... 213/1 A
8,496,128 B2 * 7/2013 Gagliardino ..... 213/62 A
2009/0321376 A1 * 12/2009 Meyer et al. ..... 213/22
2012/0298610 A1 * 11/2012 Jiang et al. ..... 213/7
2014/0144863 A1 * 5/2014 Sagawa et al. ..... 213/7

* cited by examiner

DEVICE FOR COUPLING HIGH-SPEED RAILROAD CARS AND METHOD FOR REMOVING DEVICE

TECHNICAL FIELD

The present invention relates to a device for coupling tilting railroad cars which are to be installed at the front and the middle of a high-speed railroad train, and in particular at the front part of the front car of a high-speed railroad train, and a method for removing this device from the cars during maintenance.

BACKGROUND ART

A device for coupling railroad cars to each other has a structure with a coupling pin 4 which joins a coupler 1 to a shock absorber 2 which absorbs and buffers shocks generated mutually between the cars while accelerating and decelerating as they travel, via a coupling joint 3 provided with insertion holes 3*a* and 3*b* in a cross-wise direction (Patent Reference 1, FIG. 7 and FIG. 8). This coupling device is able to incline in the direction of width of the cars and in the direction of height of the cars. When the coupler 1 and the shock absorber 2 form a set, it is referred to as a "coupling device."

A coupling device which couples railroad cars to each other, such as is disclosed in Patent Reference 2, for example, is employed as a coupling device which couples tilting railroad cars to each other, to make possible high-speed travel on a curved rail.

As shown in FIG. 5, the coupling device disclosed in Patent Reference 2 has a rounded concave surface 12*a* forming a front inner surface of a shock absorber frame 12 which holds a shock absorber 11, and a cylindrical surface 12*b* with a vertical inner surface which extends to the rounded concave surface 12*a*. A coupling joint 13, which is intended to engage with the rounded concave surface 12*a* of the shock absorber frame 12, is provided with an insertion hole 13*b* in the shape of a short cylinder, into which is inserted a coupling pin 14 in a direction perpendicular to the axis, and has an outer peripheral surface formed in a rounded convex surface 13*a*.

An assembly of the above described coupling device operates in the following manner.

First, the coupling joint 13 is inserted from the open side 12*c* of the shock absorber frame 12, pushing in a forward direction for the rounded concave surface 12*a* to accommodate the rounded convex surface 13*a*.

Next, the shock absorber 11 with front and back held by a follower plate 15 is inserted into the shock absorber frame 12, and a rear portion 16*a* of a coupler 16 is inserted into the short cylinder of the coupling joint 13 from the front of the shock absorber frame 12.

Finally, the coupling pin 14 is inserted into the insertion hole 13*b*, and the rear portion 16*a* of the coupler 16 couples with the shock absorber frame 12, after which a locking screw 17 anchors a stop plate 18 in a setting groove 13*c* provided at both ends of the insertion hole 13*b*, so that the coupling 14 will not come lose. In this state, a rounded concave surface 15*a* provided to the front surface of the follower place 15 contacts a rounded convex surface 16*aa* of the rear portion 16*a* of the coupler 16.

This enables a smooth rotation and a vertical and widthwise inclination of the coupler 16 with respect to the shock absorber frame 12.

In areas where high-speed railroad cars and conventional railroad cars travel, there are instances when the high-speed railroad cars and the conventional railroad cars are coupled along their routes, and instances when the high-speed railroad cars and the conventional railroad cars are decoupled to run separately along their routes. In such cases, the front cars of the high-speed train must be coupled to the conventional railroad cars.

However, there are many cases in which the front part of the front car for a high-speed train, which has special vehicle components in the front part, has no extra space at all on the right and left sides, or hardly any space on the top of a position where a coupling device is mounted. In such cases, after installing a coupling device used for coupling tilting cars to the front part of the front cars of the high-speed train, there is no space to remove the entire coupling device during maintenance, and to mount it after maintenance.

Therefore, when the coupling device disclosed in Patent Reference 2 is installed at the front part of the front car of a high-speed train, the locking screw for anchoring the stop plate in position on the right and left side of the coupling device during maintenance is removed, making it impossible to disassemble and remove the coupler and the shock absorber. Even if the coupling device is rotated 90° from its installed position during maintenance, there is hardly sufficient space above, so the operation of removing the locking screw is very difficult.

PRIOR ART REFERENCES

Patent References

Patent Reference 1: Japanese Patent Application Kokai Publication No. 2005-219685

Patent Reference 2: Japanese Patent Application Kokoku Publication No. Showa 44-16967

SUMMARY OF THE INVENTION

Problem to be Solved by the Invention

The problem to be solved by the present invention is that the operation of removing and mounting the coupling device is very difficult during maintenance in cases where there is no space to remove the entire coupling device above or on the side of the mounting position of the coupling device at the front part of the front car of a high-speed train.

Means for Solving these Problems

The object of the present invention is to make the operation of removing and mounting the coupling device during maintenance easy in cases where there is no space to remove and mount the entire coupling device above or on the side of the mounting position of the coupling device at the front part of the front car of a high-speed train.

The device for coupling high-speed railroad cars according to the present invention comprises a coupler, a shock absorber held in a shock absorber frame and a coupling joint which joins the coupler and the shock absorber held in the shock absorber frame by a coupling pin. The shock absorber frame has a front-end wall partially cut in an inverted cone shape so as to have a front inner surface with a semi-circular concave inner surface to which a cylindrical inner surface extends. The coupling joint has a structure such that a circumferential surface of a short cylinder into which is inserted a rear portion of the coupler which is inserted from the opening of the shock absorber frame forms a rounded convex surface which engages with the semi-circular concave surface of the shock absorber frame, and an insertion hole is provided in a direction perpendicular to the axis of the short cylinder. In the shock absorber frame, there is provided a removal hole for the coupling pin which is disposed at a position to rotate at a predetermined angle in a circumferential direction in the assembled state, and at a position coaxial with the coupling pin in the assembled state in which the coupling pin is inserted into an insertion hole of the coupling joint into which is inserted the rear portion of the coupler which is inserted from the opening.

In the device for coupling high-speed railroad cars according to the present invention described above, one end of the coupling pin is provided with a screw hole for attaching a hanging bolt, and it is advantageous to provide an air release hole at a position facing the pin removal hole for the coupling pin.

In the device for coupling high-speed railroad cars according to the present invention described above, the coupler is rotated until the removal hole and the coupling pin provided in the shock absorber frame are in a coaxial position, and subsequently, if the hanging bolt is screwed into the screw hole of the coupling pin, for example, after which the coupling pin is pulled out from the coupling joint, and the coupler is pulled away from the shock absorber frame in opposite directions, then the coupling device can be separated from the coupler and from the shock absorber frame which holds the shock absorber and the coupling joint, thereby making it possible to remove the coupling device from the front part of the front car of a railroad train during maintenance.

After the maintenance is completed, the reverse process may be performed to mount the coupling device to the front part of the front car of the railroad train.

Advantageous Effects of the Invention

According to the present invention, even in cases where there are special vehicle components in the front part, so there is no space at the top or on the side where the coupling device is mounted, for mounting and removing the entire coupling device, it is possible to easily remove and mount the coupling device for tilting railroad cars at the front part.

BRIEF DESCRIPTION OF THE DRAWINGS

FIG. 1 (*a*) is a frontal view and FIG. 1 (*b*) is a planar view.

FIG. 4 (*a*) is a frontal view and FIG. 4 (*b*) is a planar view.

FIG. 5 (*a*) is a frontal view and FIG. 5 (*b*) is a planar view.

EMBODIMENTS OF THE INVENTION

According to the present invention, the object of making the operation of removing and mounting the coupling device easy, even when there is no space to mount and remove the entire coupling device above or on the side of the mounting position of the coupling device, is achieved by providing a removal hole for the coupling pin at a position to rotate at a predetermined angle in a circumferential direction in the assembled state, and at a position coaxial with the coupling pin in the assembled state in the shock absorber frame.

Embodiment

An embodiment of the present invention is described below, making reference to FIG. 1 to FIG. 3.

Figure 1:
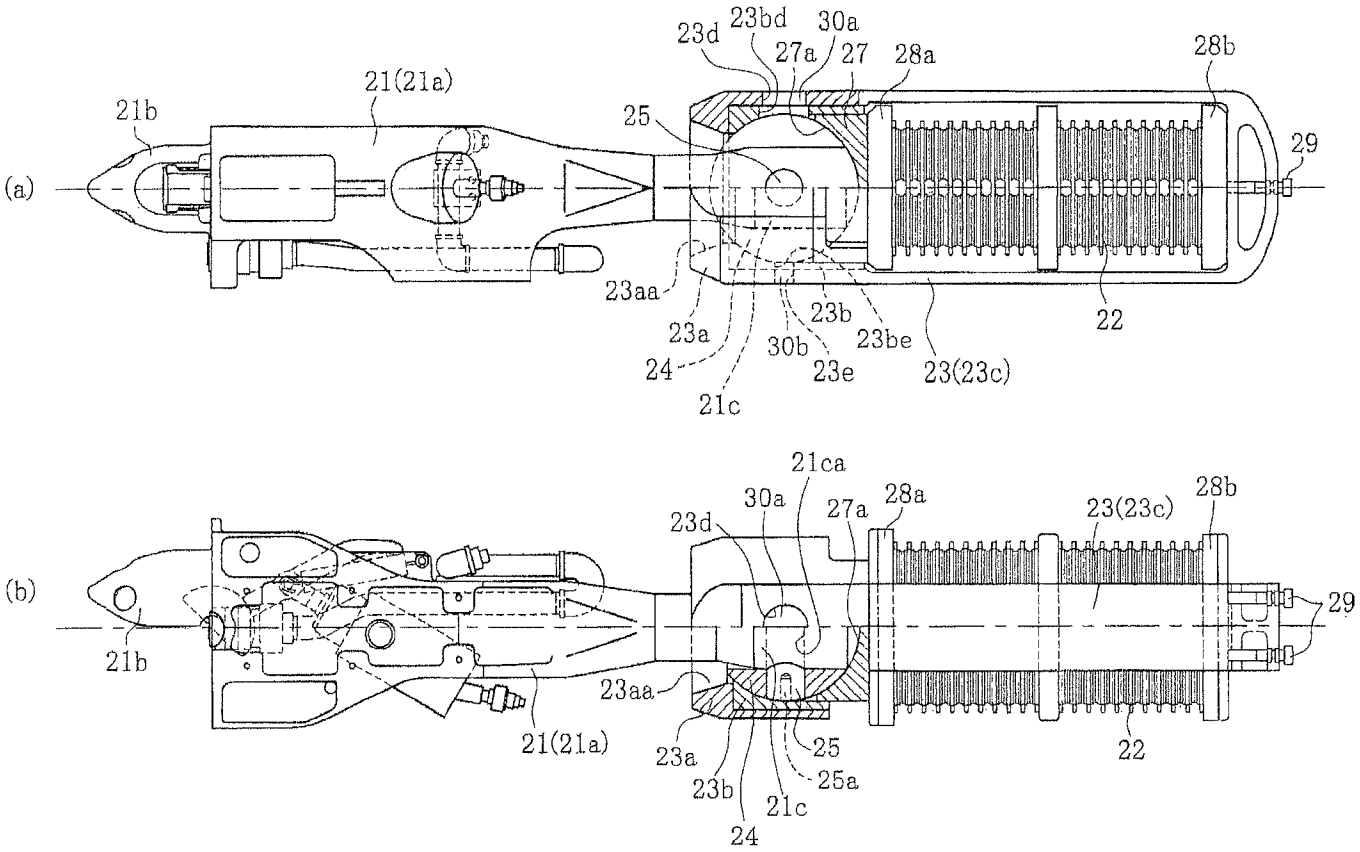
FIG. 1 is a drawing of a device for coupling high-speed railroad cars according to the present invention mounted on the front part of a front car of a high-speed railroad train.
Figure 2:
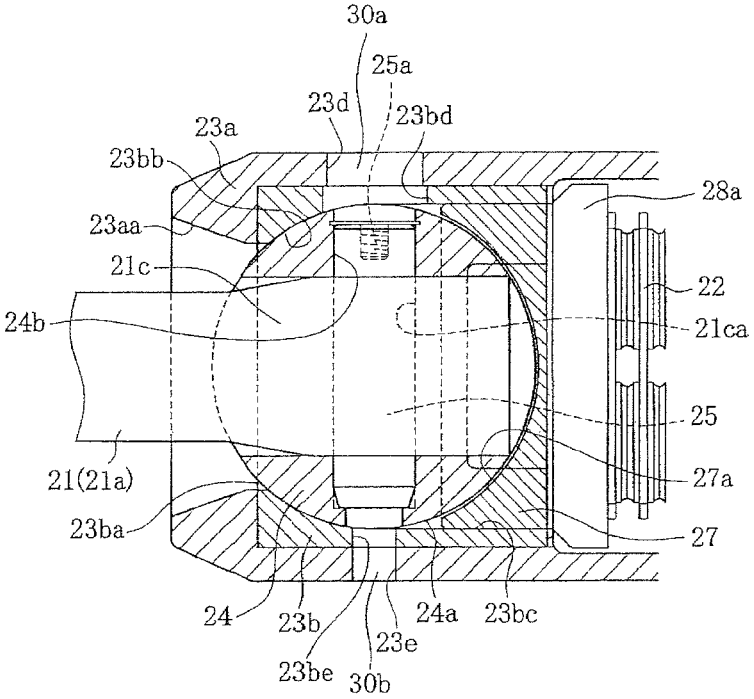
FIG. 2 is a drawing showing an enlarged view of the coupling site between the coupler and the coupling joint which is inserted into the shock absorber frame which holds the shock absorber.

FIG. 1 is a drawing of a device for coupling high-speed railroad cars according to the present invention mounted on the front part of a front car of a high-speed railroad train, and FIG. 2 is a drawing showing an enlarged view of the coupling site between the coupler and the coupling joint which is inserted into the shock absorber frame which holds the shock absorber.

Reference Numeral 21 is an ordinary tight coupler (referred to below simply as a coupler), which has a head part 21*b* for coupling to the front end part of a coupler main body 21*a*, and forms a junction part 21*c* with a coupling joint 24 at the rear portion of the opposite side. An insertion hole 21*ca* through which a coupling pin 25 passes is provided in the junction part 21*c*.

Reference Numeral 22 is a shock absorber (e.g., laminated rubber) which absorbs acceleration and deceleration when the cars accelerate and decelerate while traveling and prevents generation of an impact, and which is held in a shock absorber frame 23.

The shock absorber frame 23 includes a holding member 23*c* of the shock absorber 22 which is open at both ends, and has a front inner surface with an opening 23*aa* at a front-end wall 23*a* partially cut in an inverted cone shape, into which is inserted a frame 23*b*, and which extends along the inserted frame 23*b*.

The frame 23*b* has a structure which includes the opening 23*aa* and an opening 23*ba* through which the front surface is supposed to pass, and the inner surface thereof forms a semi-circular concave surface 23*bb* and a cylindrical surface 23*bc* from a front surface side.

Reference Numeral 24 is a coupling joint which joins the coupler 21 and the shock absorber 22 held in the shock absorber frame 23 by means of the coupling pin 25. This coupling joint 24 includes a rounded convex surface 24*a* which engages with the semi-circular concave surface 23*bb* of the shock absorber frame 23, and includes a circumferential surface of a short cylinder into which is inserted the junction part 21*c* of the coupler 21 which is inserted from the opening 23*aa* of the shock absorber frame 23. In addition, an insertion hole 24*b* is provided for connecting with the insertion hole 21*ca* in a direction perpendicular to the axis of the short cylinder.

According to the present invention, in an assembled state in which the coupling pin 25 is inserted through the insertion hole 24*b* of the coupling joint 24 into which the junction part 21*c* of the coupler 21 is inserted from the opening 23*aa* of the shock absorber frame 23, passing through the insertion hole 21*ca* of the junction part 21*c*, the following structure is further added to the shock absorber frame 23 and the coupling pin 25.

According to the present invention, in the assembled state described above, removal holes 23*d* and 23*bd* and air release holes 23*e* and 23*be* of the coupling pin 25 are disposed facing each other at a position rotated at 90°, for example, in the circumferential direction of the shock absorber frame 23, and at a position coaxial with the coupling pin 25.

On the other hand, a screw hole 25*a* for attaching a hanging bolt 26 is provided at one end of the coupling pin 25, and the other end portion is machined so as to taper narrowly at the other end.

In FIG. 1, Reference Numeral 27 is a sliding plate which has a semi-circular concave surface 27*a* for holding the coupling joint 24 together with a semi-circular concave surface 23*bb* of the frame 23*b*, and Reference Numerals 28*a* and 28*b* are follower plates positioned to make contact with the front and back of the shock absorber 22, so as to insert the shock absorber 22 in the shock absorber frame 23.

The device for coupling high-speed railroad cars according to the present invention with the additional structure described above is mounted on a railroad car in the following sequence.

First, the frame 23*b* is inserted into the front inner surface of the shock absorber frame 23. Then, the coupling joint 24 is inserted from the open part of the holding member 23*c* of the shock absorber frame 23 so that the central axis of the short cylinder and the central axis of the opening 23*aa* are in alignment with the circumferential direction of the insertion hole 24*b* and the removal holes 23*bd* and 23*d*.

After that, the sliding plate 27 is inserted from the open part of the holding member 23*c* of the shock absorber frame 23 from the rear of the coupling joint 24 which presses on the side of the frame 23*b* and is accommodated by the semi-circular concave surface 23*bb*, to hold the coupling joint 24 with the semi-circular concave surface 23*bb* and the semi-circular concave surface 27*a* of the sliding plate 27. In this state, the insertion hole 24*b* and the removal holes 23*bd* and 23*d* are not only in axial alignment with the circumferential direction, but they are also in axial alignment with the coupling joint 24.

Next, the shock absorber 22 which is in contact with the front and back follower plates 28*a* and 28*b* is inserted into the shock absorber frame 23 from the opening of the holding member 23*c*, and the shock absorber 22 is held by tightening a bolt 29 which is screwed in from the back end surface of the shock absorber frame 23.

When the shock absorber frame 23 is arranged on the railroad car in a state in which it holds the coupling joint 24 and the shock absorber 22 as described above, the bolt 29 is removed.

After that, the junction part 21*c* formed at the rear portion of the coupler 21 is inserted from the opening 23 aa of the shock absorber frame 23 arranged on the railroad car, and it is inserted into the short cylinder of the coupling joint 24 until the insertion hole 21*ca* of the junction part 21*c* and the insertion hole 24*b* of the coupling joint 24 are in alignment.

Finally, the coupling pin 25 into which is screwed the hanging bolt 26 through the screw hole 25*a* is inserted from the removal holes 23*bd* and 23*d*, to join the coupler 21 to the shock absorber frame 23 which holds the shock absorber 22 via the coupling joint 24. After coupling these, the hanging bolt 26 is removed, and the coupler 21 is rotated 90% and as needed, rubber stoppers 30*a* and 30*b* can be applied, for example, to the removal hole 23*d* and the air release hole 23*e*.

Next, removal of the coupling device from the railroad car during maintenance is performed as described below.

Figure 3:
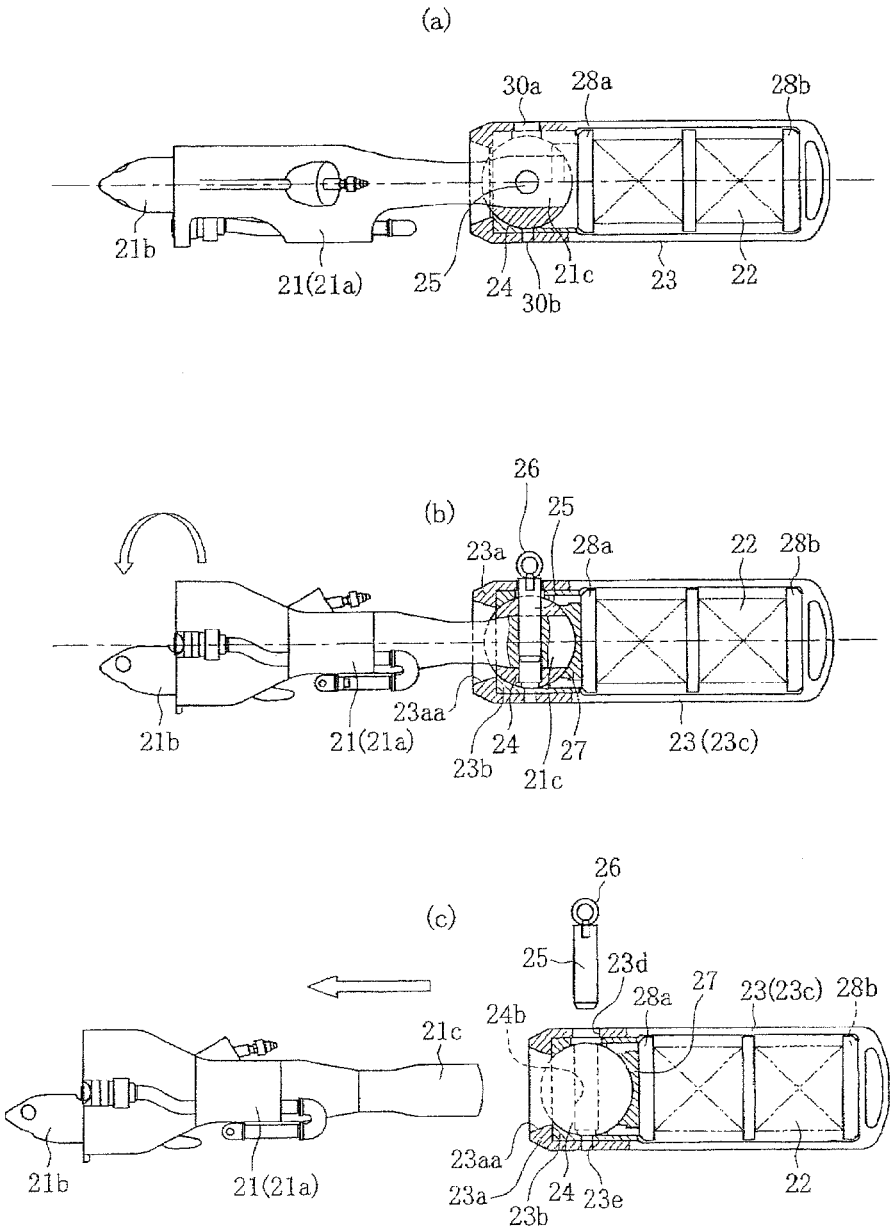
FIG. 3 (*a*)-FIG. 3 (*c*) are drawings illustrating the sequence followed in implementing the method of removing the device for coupling high-speed railroad cars according to the present invention.
Figure 4:
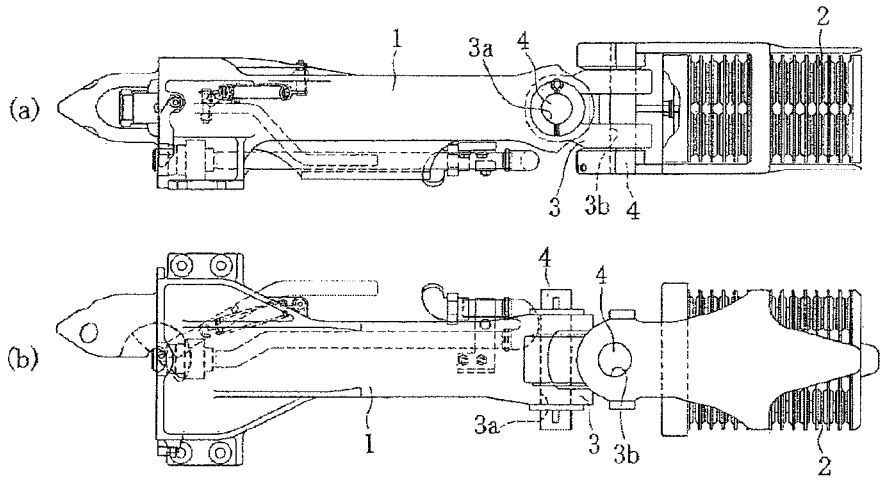
FIG. 4 is a drawing of the coupling device used for coupling non-tilting railroad cars.
Figure 5:
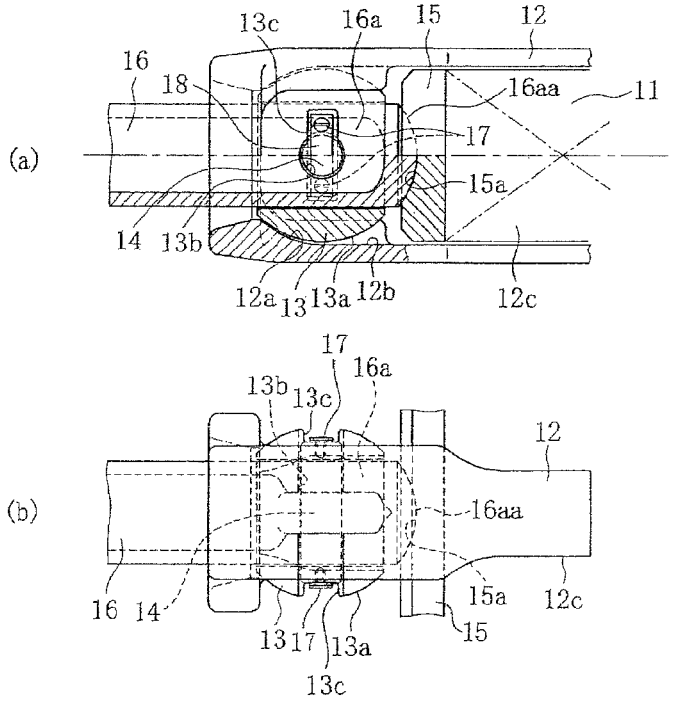
FIG. 5 is a drawing of junction part of the coupling device used for coupling tilting railroad cars.

First, in the state shown in FIG. 3 (*a*), the rubber stoppers 30*a* and 30*b* are removed from the removal hole 23*d* and the air release hole 23*e*.

Next, as shown in FIG. 3 (*b*), the coupler 21 is rotated until the removal holes 23*bd* and 23*d* and the coupling pin 25 reach a coaxial position, which the operator checks via the removal hole 23*d* from which the rubber stopper 30*a* was removed. After that, the hanging bolt 26 is screwed into the screw hole 25*a* of the coupling pin 25, and the coupling pin 25 is pulled out from the coupling joint 24.

Finally, as shown in FIG. 3 (*c*), the coupler 21 is pulled in a direction opposite from the shock absorber frame 23, so as to separate the coupler 21 from the shock absorber frame 23 which holds the shock absorber 22 and the coupling joint 24, and it is removed from the railroad car.

According to the present invention, it is possible to remove and mount the coupling device, even if there is no space to mount and remove the entire coupling device above or on the side of the mounting position of the coupling device, because the coupler 21 can be separated from the shock absorber frame 23 which holds the shock absorber 22 and the coupling joint 24.

The present invention is not limited to the example described above, and the embodiment may, of course, be advantageously modified within the scope of the technical ideas recited in the claims.

For example, in the above example, the rounded concave surface and the cylindrical surface provided to the front inner surface of the shock absorber frame 23 were formed by inserting the frame 23*b* having the rounded concave surface 23*bb* and the cylindrical surface 23*bc* formed on the inner surface, but a rounded surface and a cylindrical surface may be directly formed on the front inner surface of the shock absorber frame 23.

In the above example, the screw hole 25*a* was provided for attaching the hanging bolt 26, but instead of the screw hole, simply a hole may be provided, into which a hard rubber is inserted, and the coupling pin 25 may be pulled out by holding a grip attached to the hard rubber.

It is easier to pull out the coupling pin 25 if the air release hole 23*e* is provided, as in the above example, but there is no necessity to provide the air release hole 23*e*.

The device for coupling high-speed railroad cars according to the present invention was devised primarily to be used in the front part of the front car of high-speed railroad trains, but it may of course also be used in the coupling part of the middle cars of high-speed railroad trains.

Explanation of The Reference Numerals

21 Coupler
21*c* Junction part
21*ca* Insertion hole
Shock absorber
Shock absorber frame
23*a* Front-end wall
23*aa* Opening
23*b* Frame
23*ba* Opening
23*bb* Semi-circular concave surface
23*bc* Cylindrical surface
23*c* Holding member
23*d* Removal hole
23*e* Air release hole
25 Coupling joint
24*a* Rounded convex surface
24*b* Insertion hole
Coupling pin
25*a* Screw hole
26 Hanging bolt
Sliding plate
27*a* Semi-circular concave surface
28*a*, 28*b* Follower plates
Bolt
30*a*, 30*b* Rubber stopper

The invention claimed is:

1. A device for coupling high-speed railroad cars comprising:

a coupler;

a shock absorber held in a shock absorber frame; and a coupling joint which joins the coupler and the shock absorber held in the shock absorber frame by a coupling pin, wherein the shock absorber frame has a front-end wall partially cut in an inverted cone shape so as to have a front inner surface with a semi-circular concave inner surface to which a cylindrical inner surface extends, the front inner surface having a wall surface having an entire circumference, the coupling joint has a structure such that a circumferential surface of a short cylinder into which is inserted a rear portion of the coupler which is inserted from the opening of the shock absorber frame forms a rounded convex surface which engages with the semi-circular concave surface of the shock absorber frame, and an insertion hole is provided in a direction perpendicular to the axis of the short cylinder, and in the shock absorber frame, there is provided a removal hole for the coupling pin which is disposed at a position to rotate at a predetermined angle in a circumferential direction in the assembled state, and at a position coaxial with the coupling pin in the assembled state in which the coupling pin is inserted into an insertion hole of the coupling joint into which is inserted the rear portion of the coupler which is inserted from the opening.

2. The device for coupling high-speed railroad cars according to claim 1, further comprising a screw hole for attaching a hanging bolt at one end of the coupling pin.

3. The device for coupling high-speed railroad cars according to claim 1, further comprising an air release hole disposed in a position facing the removal hole for the coupling pin.

4. A method for removing the device for coupling high-speed railroad cars according to claim 2, the method comprising:

rotating the coupler until the removal hole provided in the shock absorber frame and the coupling pin reach a coaxial position, screwing the hanging bolt into the screw hole of the coupling pin, pulling the coupling pin out from the coupling joint, pulling the coupler in a direction opposite from the shock absorber frame, so as to separate the coupler from the shock absorber frame which holds the shock absorber and the coupling joint, and removing them from the high-speed railroad car.

5. The device for coupling high-speed railroad cars according to claim 2, further comprising an air release hole disposed in a position facing the removal hole for the coupling pin.

6. A method for removing the device for coupling high-speed railroad cars according to claim 5, the method comprising:

rotating the coupler until the removal hole provided in the shock absorber frame and the coupling pin reach a coaxial position, screwing the hanging bolt into the screw hole of the coupling pin, pulling the coupling pin out from the coupling joint, pulling the coupler in a direction opposite from the shock absorber frame, so as to separate the coupler from the shock absorber frame which holds the shock absorber and the coupling joint, and removing them from the high-speed railroad car.

* * * * *